United States Patent [19]

Dunau

[11] Patent Number: 4,525,889

[45] Date of Patent: Jul. 2, 1985

[54] PAINT BRUSH HOLDER

[76] Inventor: Mark J. Dunau, P.O. Box 413, Wolfeboro, N.H. 03894

[21] Appl. No.: 610,778

[22] Filed: May 16, 1984

[51] Int. Cl.[3] ..... B05C 17/00; A46B 17/02

[52] U.S. Cl. ..... 15/146; 15/143 R; 15/144 R; 15/145; 403/329

[58] Field of Search ..... 15/143 R, 144 R, 145, 15/146, 176, 143 B, 144 B; 403/329, 361

[56] References Cited

U.S. PATENT DOCUMENTS

| | | | |
|---|---|---|---|
| 673,430 | 5/1901 | Flanders | 403/329 |
| 2,469,050 | 5/1949 | Mygas | 15/144 R |
| 2,792,581 | 5/1957 | Woyton | 15/144 R |
| 3,319,280 | 5/1967 | Trachsler | 15/146 |
| 3,413,043 | 11/1968 | Bertolina | 15/144 R |
| 3,894,807 | 7/1975 | Betz | 15/146 |
| 3,925,908 | 12/1975 | Dunn | 15/38 |

*Primary Examiner*—Edward L. Roberts

*Attorney, Agent, or Firm*—Hopgood, Calimafde, Kalil, Blaustein & Judlowe

[57] ABSTRACT

A paint brush holder and length extender including a block supported on a pole. The block includes an opening at its upper end which receives a resilient spring clip adapted to hold one of a variety of different sized paint brushes at a distance from the worker thereby making brush changing efficient and rapid and making safer the painting of areas which would normally necessitate the use of a ladder; the paint brush may be positioned in a plurality of fixed angles with respect to the pole for ease of working.

2 Claims, 5 Drawing Figures

PAINT BRUSH HOLDER

BACKGROUND OF THE INVENTION

This invention relates generally to paint brush holders, and more particularly to a paint brush holder and length extender which provides for easy and safe access to areas to be painted which are at a distance from the painter.

In the usual method of painting a remote area, use is made of a step ladder, cradle or scaffold. Although this method is reasonably satisfactory in most instances, it has a number of substantial drawbacks, primarily in that in many instances the individual painting the area is put in a relatively unsafe position.

Moreover, constant shifting is necessary since the workman can only reach a small area of the surface to be painted. In this respect, the workman spends a considerable amount of unproductive time in stepping off the ladder or scaffold, repositioning it, and reascending.

In order to overcome these drawbacks, a number of paint brush holders have been developed, examples of which are described in U.S. Pat. Nos. 2,346,570, 2,469,050, and 3,994,037. Although these brush holders are intended to overcome many of the problems described above, they are unable to be quickly adapted to a variety of paint brush sizes, and in addition they require time-consuming screwing and unscrewing operations to change the position of the brush relative to the surface being painted, and to remove and insert various paint brush handles into the holder.

A need therefore exists for a paint brush holder and length extender which not only allows for easy access to remote areas but also is easily and quickly adaptable to a range of paint brush sizes, and can be easily rotated through any angle and locked in that chosen position. Moreover, the need exists for a paint brush holder and length extender which not only allows for easy access to remote areas but also is easily and quickly adaptable to a range of paint brush sizes, and can be easily rotated through any angle and locked in that chosen position.

OBJECTS OF THE INVENTION

It is an object of the present invention to provide an improved paint brush holder.

It is another object of the present invention to the provide a paint brush holder and length extender which allows for the safe, efficient and rapid painting of areas normally not within the worker's reach.

It is a further object of the present invention to provide an improved paint brush holder, which is adapted to receive a variety of different-sized paint brushes, which may be disposed at any desired angle with respect to the hand grasp, and which may be used to facilitate painting remote areas which the painter would normally have required a ladder to reach.

SUMMARY OF THE INVENTION

According to the present disclosure, a paint brush holder and length extender includes a block containing a central core, and a spring clip within the core to securely hold a paint brush handle after insertion. The base of the block contains an internally threaded socket meant to receive a standard externally threaded pole. A bolt extends through the block to permit angling of the brush between 90° and 180° relative to the pole.

BRIEF DESCRIPTION OF THE DRAWING

For a fuller understanding of the invention reference is made to the following description given in connection with the accompanying drawings of the preferred embodiment in which.

DESCRIPTION OF THE PREFERRED EMBODIMENT

Figure 1:
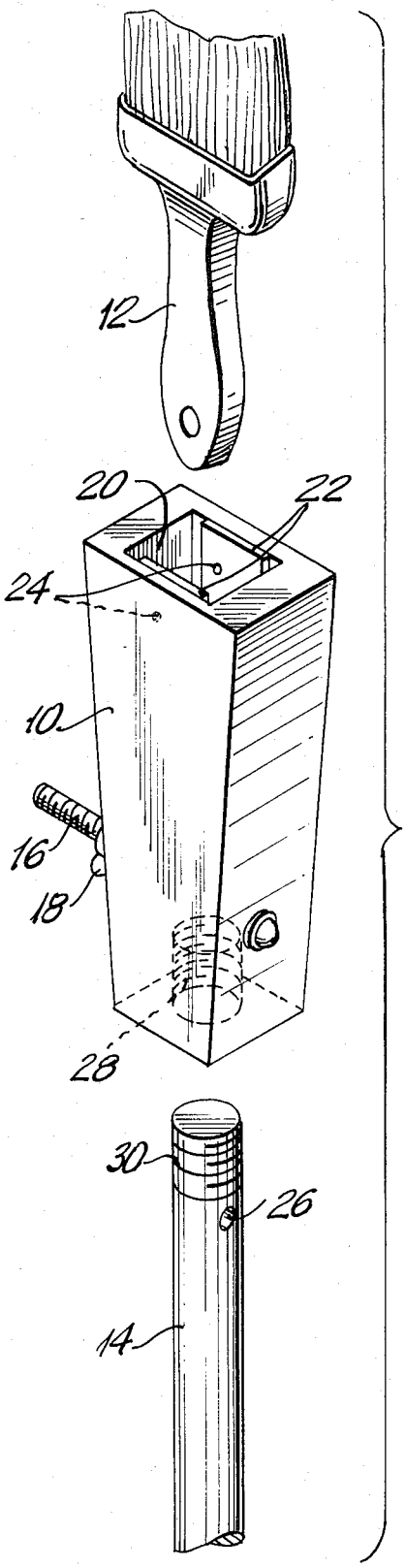
FIG. 1 is an exploded view in perspective of the paint brush holder and length extender of the present invention showing the pole below the block.
Figure 2:
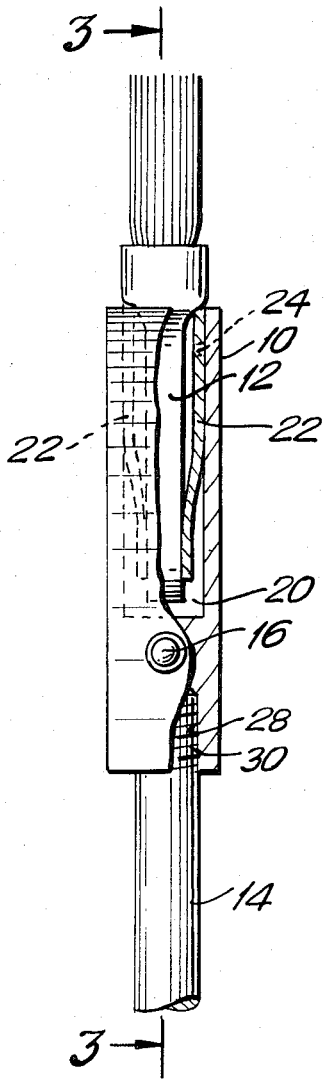
FIG. 2 is a side view partially in cross section of the paint brush holder and length extender of the present invention.
Figure 3:
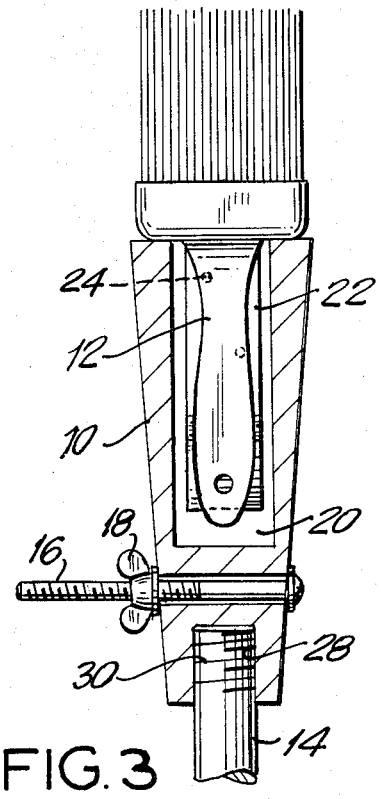
FIG. 3 is a cross section of the paint brush holder, broomstick and brush as viewed across the section lines 3—3 of FIG. 2.

As shown in the drawings, the paint brush holder of the present invention comprises an elongated, preferably tapered block 10 that may be constructed of any lightweight sturdy material such as wood, plastic or metal.

The block 10 has formed therein a central opening or core 20 at the upper end adapted to receive the brush handle 12. A resilient member 22 such as a spring clip is securely disposed in the core 20 and serves to exert pressure on the handle of the brush inserted into the core 20 and serves to exert pressure on the handle of the brush inserted into the core 20 to retain the brush securely in position after its insertion into the block. The resilient member 22, may be attached to the block 10 at the interior of the opening 20, by suitable means 24, such as screws.

The block 10 also includes at its lower end, an internally threaded recess of ferrule 28 to accommodate the external threads 30 of an externally threaded pole 14. As shown in FIG. 1, the pole 14 may be screwed into the internally threaded recess 28 of the block 10. The paint brush is thereby disposed substantially coaxially relative to the longitudinal axis of the pole 14.

Figure 4:
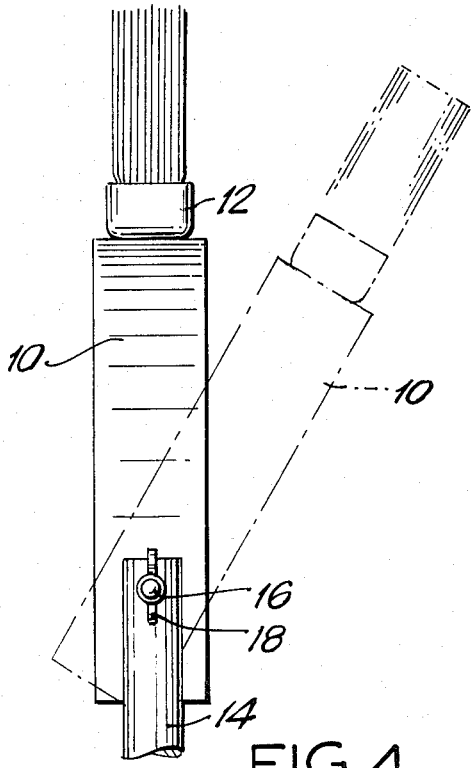
FIG. 4 is a side view demonstrating two possible angular orientations of the paint brush when inserted into the paint brush holder of the invention.
Figure 5:
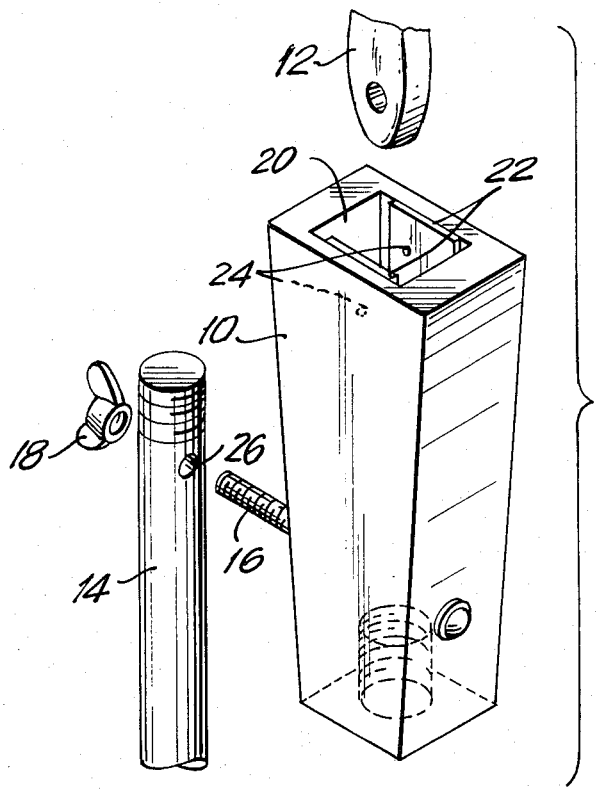
FIG. 5 is an exploded view in perspective of the paint brush holder and length extender of the present invention showing the pole alongside the block.

Alternatively, as shown in FIGS. 4 and 5, the pole 14, may be secured to the block 10 to allow the brush to be mounted at any angle relative to the pole 14. To this end a bolt 16 extends from one side of the block 10 through the area below the core 20 and above the socket 28, and extends past the opposite side of the block 10. The pole 14 is adapted via a bore 26 drilled through it to accommodate the bolt 16 and thereby be attached to the block to accommodate the bolt 16 and thereby be attached to the block 10 for selective angular movement with respect to the block. A wing nut 18 is provided to tighten the fit between the pole 18 and block 10. The bolt 16 is passed through the bore 26 and the block 10 is placed into the desired position, at any angle relative to the pole 14. After the position is chosen, the wing nut 18 is tightened so that the desired angle is not lost.

Thus the paint brush holder may be used in either of two ways. When the pole 14 is screwed into the internally threaded socket of the block 10, the brush will be vertically disposed relative to the pole 14. When the pole 14 is attached to the block 10 by inserting the bolt 16 through the bore 26 in the pole 14 and the wing nut 18 is tightened, the brush will be disposed at any one of a variety of angles relative to the pole 14. The painter elects whether to use the brush holder as shown in FIG. 1 or shown in FIG. 5, depending on the distance and position of the surface to be painted. The unique versatility of the present invention will be readily apparent to those skilled in the art.

Since numerous modifications will readily occur to those skilled in the art after a consideration of the foregoing specification and the accompanying drawings, it is not intended that the invention be limited to the exact construction shown and described, but also includes all suitable modifications and equivalents which may be resorted to; and it is to be understood that all such changes and modifications are included within the scope of the invention.

I claim:

1. A paint brush holder for use with a brush, said holder comprising a block having a central rectangular opening at its upper end, a spring clip having opposing faces secured to the wider interior walls of said rectangular opening and adapted to removable but securely engage and hold opposite faces of the handle of the brush within said opening, a pole, said block having an internally threaded socket formed in its lower end and operative to mate with an externally threaded end on said pole, whereby the brush may be held vertically relative to said pole, said block further including means for pivotally attaching said pole to a side of said block, whereby the brush may be selectively angled relative to said pole.

2. The paint brush holder as defined in claim 1, wherein said attaching means is a bolt passing through aligned openings in said pole and in said block at a location below that of said rectangular opening.

* * * * *

UNITED STATES PATENT AND TRADEMARK OFFICE

CERTIFICATE OF CORRECTION

PATENT NO. : 4,525,889

DATED : July 2, 1985

INVENTOR(S) : Mark J. Dunau

It is certified that error appears in the above—identified patent and that said Letters Patent is hereby corrected as shown below:

In Claim 1, line 5 change the word "removable" to "removably".

Signed and Sealed this

*Twenty-second* Day of *October 1985*

[SEAL]

*Attest:*

DONALD J. QUIGG

*Attesting Officer*

*Commissioner of Patents and Trademarks—Designate*